US006817685B2

(12) United States Patent
Lammens

(10) Patent No.: US 6,817,685 B2
(45) Date of Patent: Nov. 16, 2004

(54) RELEASE MECHANISM FOR DRAWER SLIDE LATCHES

(75) Inventor: Art E. Lammens, Fullerton, CA (US)

(73) Assignee: Accuride International Inc., Santa Fe Springs, CA (US)

( * ) Notice: Subject to any disclaimer, the term of this patent is extended or adjusted under 35 U.S.C. 154(b) by 49 days.

(21) Appl. No.: 09/924,427

(22) Filed: Aug. 8, 2001

(65) Prior Publication Data

US 2002/0021061 A1 Feb. 21, 2002

Related U.S. Application Data

(60) Provisional application No. 60/223,837, filed on Aug. 8, 2000.

(51) Int. Cl.[7] ..... A47B 88/04
(52) U.S. Cl. ..... 312/334.47; 312/333
(58) Field of Search ..... 312/330.1, 334.1, 312/334.7, 334.44, 334.46, 319.1, 334.8, 333, 334.47

(56) References Cited

U.S. PATENT DOCUMENTS

| | | | | | |
|---|---|---|---|---|---|
| 3,141,714 | A | * | 7/1964 | Valitus | 312/334.46 |
| 4,101,178 | A | * | 7/1978 | Adams et al. | 384/21 |
| 4,441,772 | A | * | 4/1984 | Fielding et al. | 312/330.1 |
| 4,549,773 | A | | 10/1985 | Papp et al. | |
| 4,560,212 | A | | 12/1985 | Papp et al. | |
| 4,679,950 | A | | 7/1987 | Delmege et al. | 384/18 |
| 4,749,242 | A | | 6/1988 | Rechberg | 312/333 |
| 4,998,828 | A | | 3/1991 | Hobbs | 384/18 |
| 5,033,805 | A | * | 7/1991 | Hobbs | 312/334.11 |
| 5,169,238 | A | | 12/1992 | Schenk | 384/21 |
| 5,255,983 | A | | 10/1993 | Parvin | 384/21 |
| 5,316,389 | A | | 5/1994 | Hoffman | 384/18 |
| 5,730,514 | A | | 3/1998 | Hashemi | 312/333 |
| 6,238,031 | B1 | * | 5/2001 | Weng | 312/333 |

FOREIGN PATENT DOCUMENTS

| | | | | |
|---|---|---|---|---|
| FR | 1174453 | * | 3/1959 | 312/334.47 |
| FR | 1458524 | * | 10/1966 | 312/334.47 |

* cited by examiner

*Primary Examiner*—James O. Hansen
(74) *Attorney, Agent, or Firm*—Christie, Parker & Hale, LLP

(57) ABSTRACT

A release mechanism for drawer slides. A latch is remotely operated by a camming or biasing translatable bar. The bar biases or cams a lever out of engagement from a tab, thereby reducing the need to directly adjust the lever.

7 Claims, 5 Drawing Sheets

RELEASE MECHANISM FOR DRAWER SLIDE LATCHES

CROSS-REFERENCE TO RELATED APPLICATION

This application claims the benefit of U.S. Provisional Application No. 60/223,837 filed on Aug. 8, 2000, which is hereby incorporated by reference as if set forth in full herein.

BACKGROUND OF THE INVENTION

The present invention is directed generally to latched drawer slides, and more specifically to a latch for maintaining a drawer slide in a preset position.

Drawer slides are used in a variety of applications, including business furniture, kitchen drawers, electronic racks, and copiers. One type of drawer slide is a telescopic drawer slide. Telescopic drawer slides often comprise two, three, four, or more telescoping members. The shape of a drawer slide, and the individual members, are determined by the design. The slides can be frictional, with members rubbing against each other with a lubricant, or a slide assembly may include roller or ball bearings for easier movement. The members in such assemblies tend to be C-shaped in nature.

Methods have been devised for stopping drawer slides from fully opening and for locking drawer slides in their open position. Such methods have at least one significant shortcoming. This shortcoming is that one must place a finger in close proximity to the juncture of the moving members. In such a position, the finger is subject to possible pinching or cutting.

Consequently, a low cost mechanism is required that will allow activation of latches while keeping fingers and hands away from areas of possible harm.

BRIEF SUMMARY OF THE INVENTION

The present invention therefore provides a release mechanism for drawer slide latches. In one embodiment the present invention provides a remote release mechanism for drawer slide latches. In one embodiment the release mechanism comprises a telescopic drawer slide having a first member slidably coupled to a second member. A latch member is affixed to the first member, the latch member engaging a tab on the second member, and a mechanism translatably coupled to the first member, the mechanism translatable to press against the latch. In one embodiment the release mechanism for a slide further comprises a latch member pivotably coupled to the first member, and the mechanism causes the latch member to pivot when translated to press against the latch.

In a further embodiment the invention comprises a drawer slide with a lock feature. The drawer slide comprises a first slide member and a second slide member slidably coupled to the first slide member. The invention further comprises a lever having a stop surface, the lever coupled to the first slide member, and a tab on the second slide member. The tab engages the stop surface when a first slide member and a second slide member are in a defined position with respect to each other. The invention further comprises means for disengaging the stop surface from the tab. In a further embodiment the invention further comprises means for biasing the means for disengaging the stop surface from the tab away from the lever.

In a further embodiment, the invention comprises, in a drawer slide with a locking disconnect latch, the drawer slide being of a telescopic type with at least two along a slide slidably coupled. A first slide is nested within a second slide, with the first slide extendable from a retracted position substantially nested within the second slide to an extended position extending from the second slide. In such an embodiment the locking disconnect latch comprises a lever pivotably mounted to the first slide, the lever including a cutout portion forming a stop surface, and means for biasing the lever, the means for biasing the lever being coupled to the first slide.

These and other aspects of the present inventionn will be more fully understood through examination of the attached figures viewed in conjunction with the following description.

DETAILED DESCRIPTION

A mechanism is provided that attaches to a member of a slide assembly. The mechanism is used to bias or cam a latch, with the latch being used to maintain at least two members of a drawer slide in a predefined position. For purposes of clarity, the mechanism is illustrated in a typical three member ball bearing slide application with C-shaped members. The mechanism is adaptable to slide assemblies with more members, or with fewer members.

Figure 1:
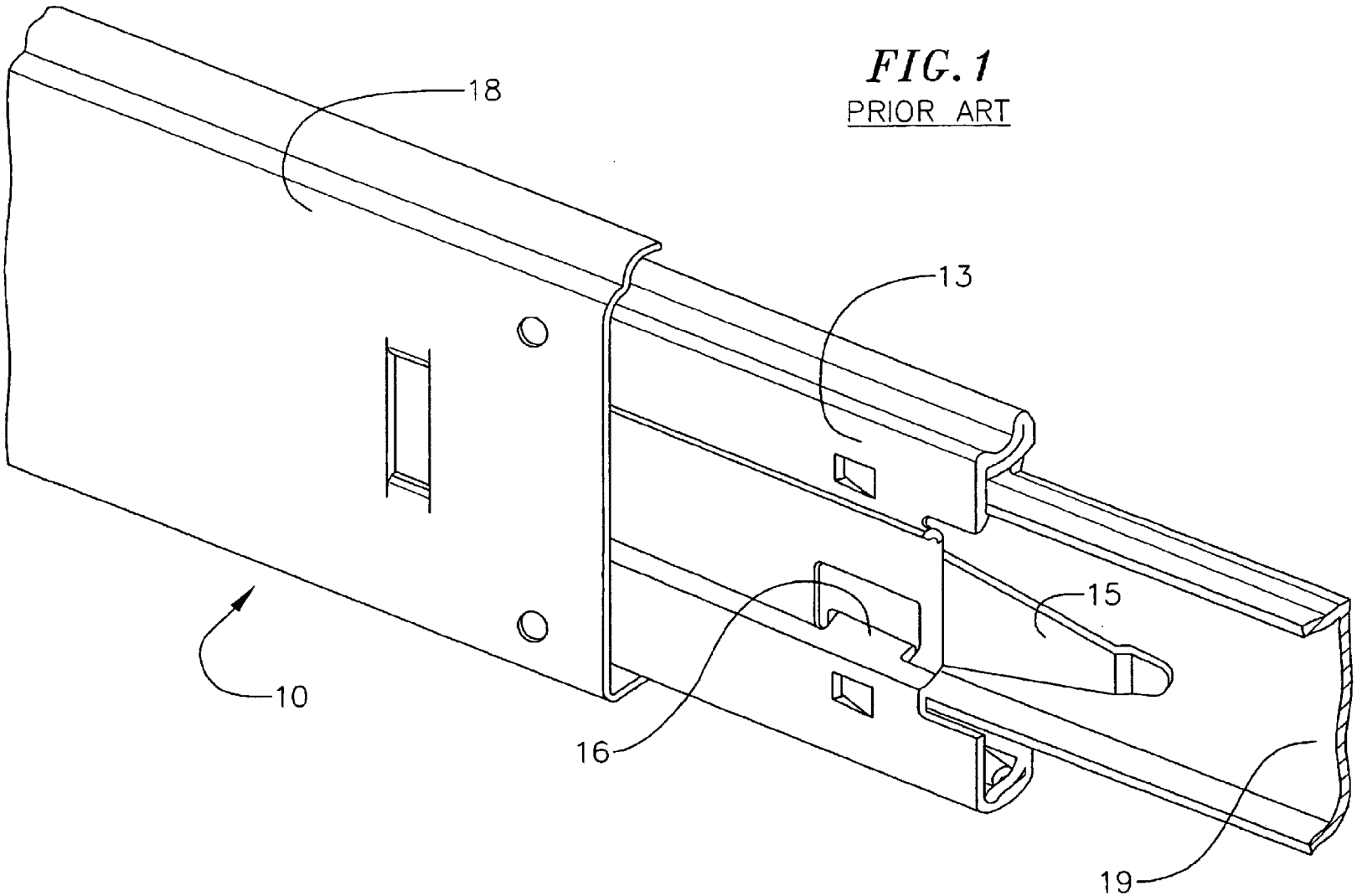
FIG. 1 PRIOR ART
FIG. 1 is an isometric side view of a three member drawer slide with latch.

As illustrated in FIG. 1, a drawer slide assembly 10 comprising an inner, or drawer, member 19 is slidably coupled to an intermediate member 13. The intermediate member in turn is slidably connected to an outer member 18. As illustrated, the slides are formed of elongate longitudinal webs having bearing raceways along their longitudinal margins. The slides are slidably coupled by bearings riding in the raceways. In alternative embodiments the slides are friction slides, slidably coupled by contact points along the slides.

As illustrated, the inner member 19 includes a latch. The latch, in the embodiment described, includes an elongate member 15 pivotably or rotatably coupled near one end of the inner slide member. The latch includes stop surfaces, which are part of a cutout of the elongate member. The stop surfaces are adapted to engage, or lock, onto a lanced out tab 16 formed in the intermediate member 13. Release of the slide for closure or disconnecting for service is accomplished by rotating latch 15 away from tab 16.

Often the elongate member, or latch member, is mounted near what is the rear of the inner slide member so that the latch member is approximate a forward end of the intermediate slide member when the inner slide member is extended from the intermediate slide member. The lanced out tab, therefore, is placed near the forward end of the intermediate member, with the latch locking the slides in the open position.

Figure 2:
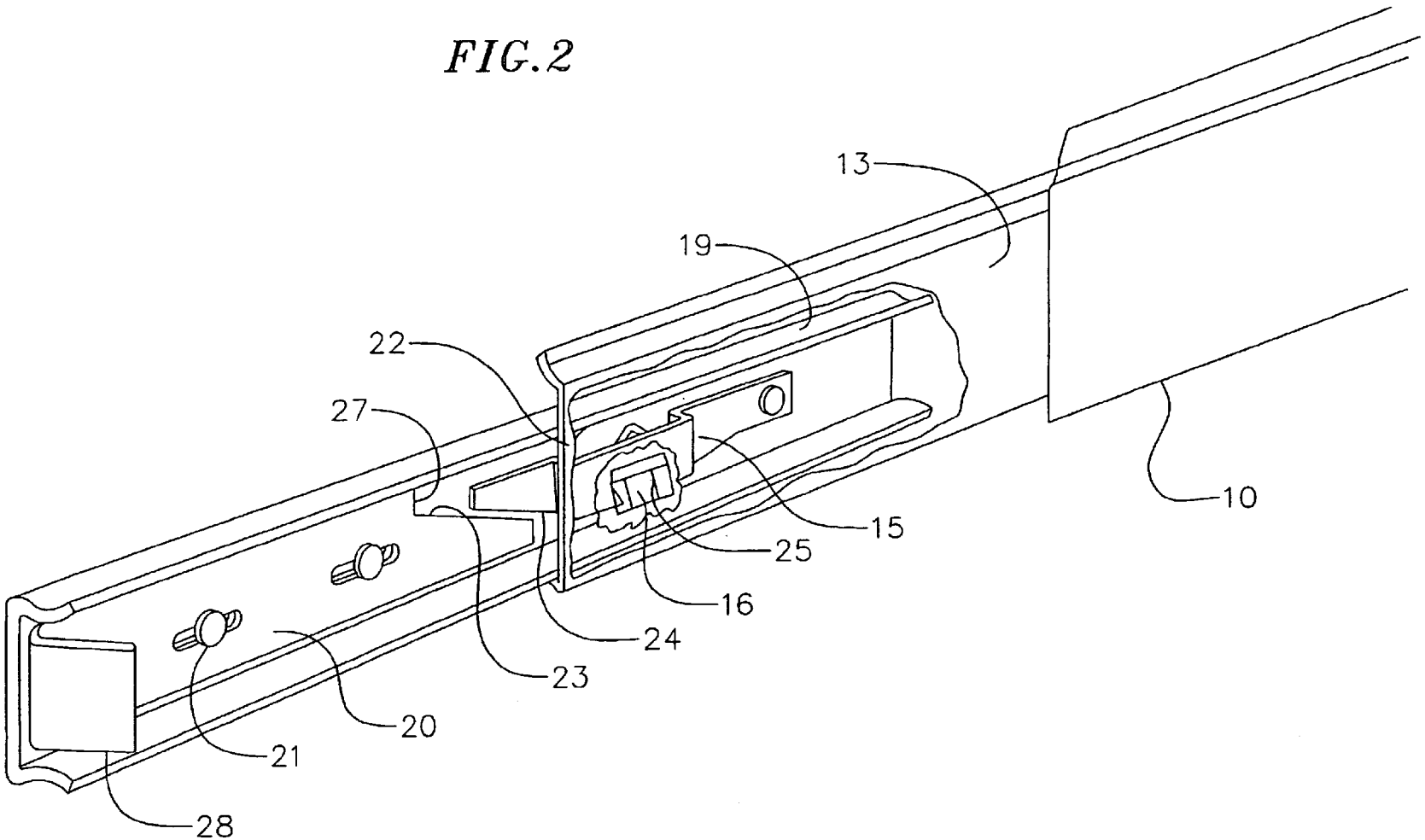
FIG. 2 is an isometric view of one embodiment of the present invention installed on a slide member with a rotating latch.

To increase the safety in releasing the latch, a mechanism 20 is attached to a drawer member 19 with shoulder rivets 21, as illustrated in FIG. 2. The shoulder rivets extend through linear slots in the mechanism. The use of shoulder rivets allows the mechanism to be moved, or translated, along the length of the inner slide member. Pushing the mechanism, particularly along a tab 28 at a forward end of the mechanism, causes an end 23 of the mechanism to press against a leading edge 24 of a latch member 15. This results in rotation of the latch member such that stop surfaces formed by a cutout 25 in the latch member do not engage a tab of the intermediate slide member (not shown in FIG. 2), thereby releasing the latch member. Depending upon the shape of the cutout, or notch, in the latch member, and the amount of push applied, the slide can be closed or disconnected.

For example, in one embodiment a forward stop surface, which restricts rearward movement of the slide member, clears the tab prior to a rearward stop surface, which restricts forward movement of the slide member. Accordingly, greater pivoting of the latch is required to allow the inner member to move forward and disconnect from the other slide members.

Further, as illustrated in FIG. 2, a spring 22 acts to oppose the pushing action and secure the latch while returning the mechanism to its original position. In addition, in one embodiment, a register 27 on the mechanism is used to prevent sufficient rotation of the latch through application of the mechanism to allow for sufficient rotation of the latch to allow for disconnect. Instead, sufficient rotation for disconnect is accomplished by hand.

Figure 3:
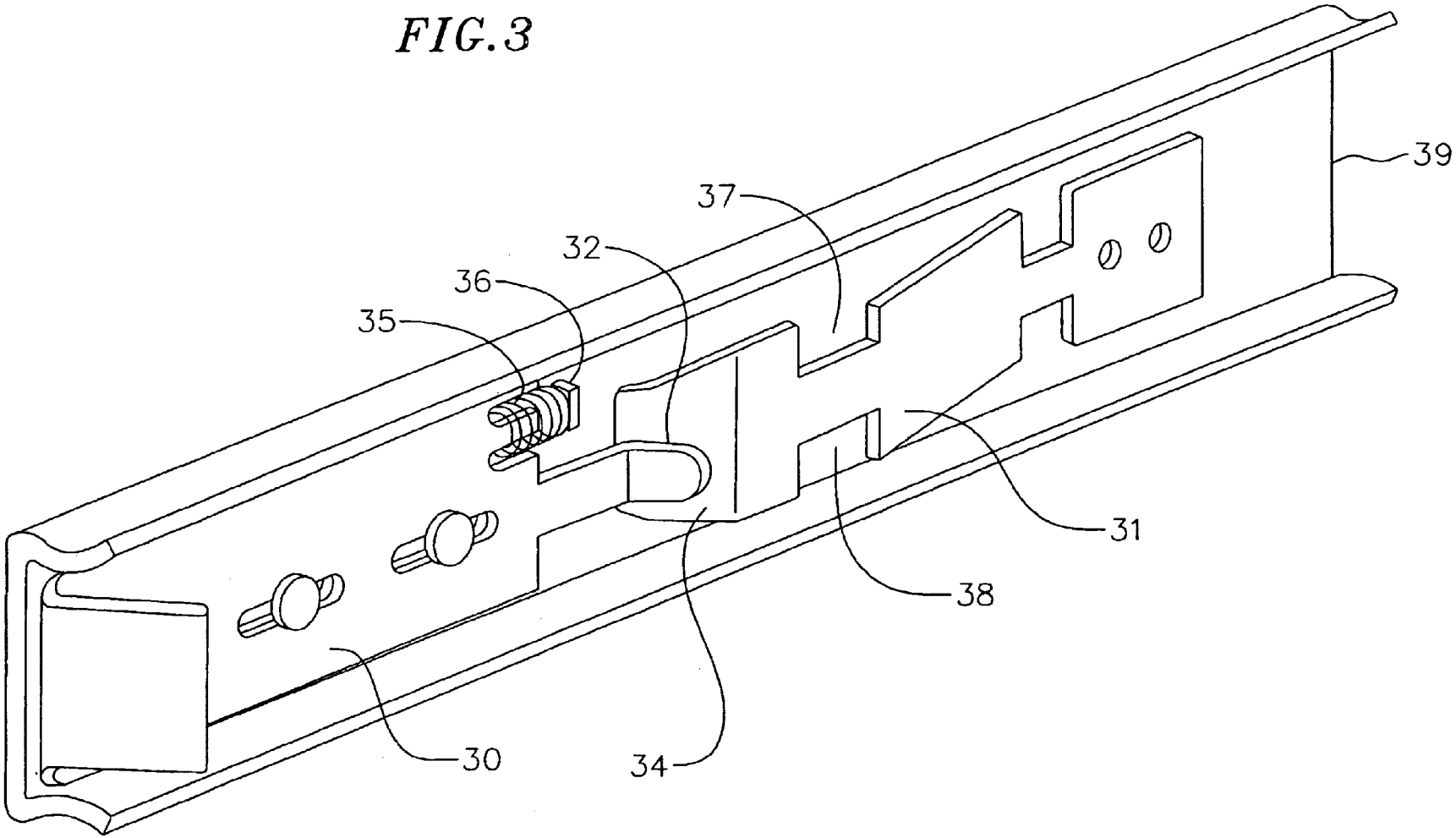
FIG. 3 is an isometric view of one embodiment of the present invention installed on a slide member with a spring latch.

A mechanism 30 can also be designed to activate a spring type latch arm 31 mounted on an intermediate member 39, as shown in FIG. 3. As illustrated in FIG. 3, an end of the mechanism 32 is shaped to cooperate with a spring latch 31 on its leading edge 34 to flatten the spring latch towards the web of the slide member. Such motion results in cutouts of the latch being freed of contact with a tab extending towards the web from another slide member. The spring latch pushes the mechanism back to its original position. The simplicity of the design results in a low cost. Return action of the release mechanism is provided by the spring qualities of the latch. However, for heavy duty applications or to satisfy a user's preference, a spring 35 can be installed between the mechanism 30 and a lanced tab 36 on the member 19. Beneficially, the spring type latch includes both upper 37 and lower 38 cutouts, thereby allowing the latch and slide member to be used with both right and left hand slides; i.e., the slide member is unhanded.

Figure 5:
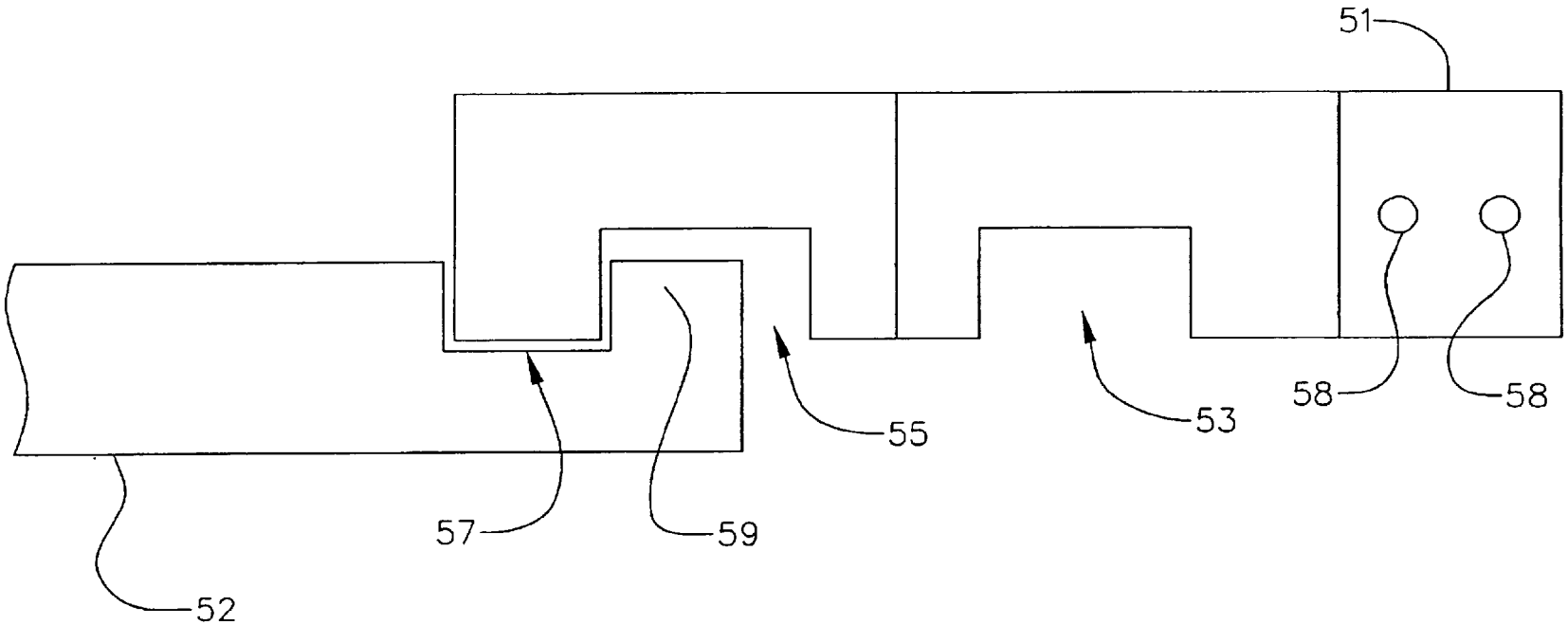
FIG. 5 is a planar side view of an alternative latch and mechanism of the present invention.

FIG. 5 illustrates an alternative embodiment in which the mechanism is pulled in order to achieve much of the effect as is accomplished with respect to the embodiment in FIG. 3. In the embodiment of FIG. 5, a latch arm 51, coupled to a drawer slide member web by rivets 58, is adjusted through use of a mechanism 52. The latch includes a cutout 53 which is adapted to receive a tab extending from another slide member. The latch is bent, as in the embodiment of FIG. 3, such that the portion of the latch including the cutout extends towards the opposing slide member. The latch also includes a second cutout 55. The second cutout is adapted to receive a protrusion 59 extending from the mechanism. Moreover, in one embodiment, the mechanism also includes a mechanism cutout 57 which is adapted to receive a protrusion extending from the latch.

Pulling a mechanism tab (not shown) on the mechanism effectively lengthens the latch arm and thereby cause the latch arm to flatten against the slide member. This movement of the latch arm results in the cutout being removed or biased away from the tab. Thus, in alternative embodiments, pulling of the mechanism away from the latch is used to disconnect the latch from a tab extending from another slide member.

Figure 4:
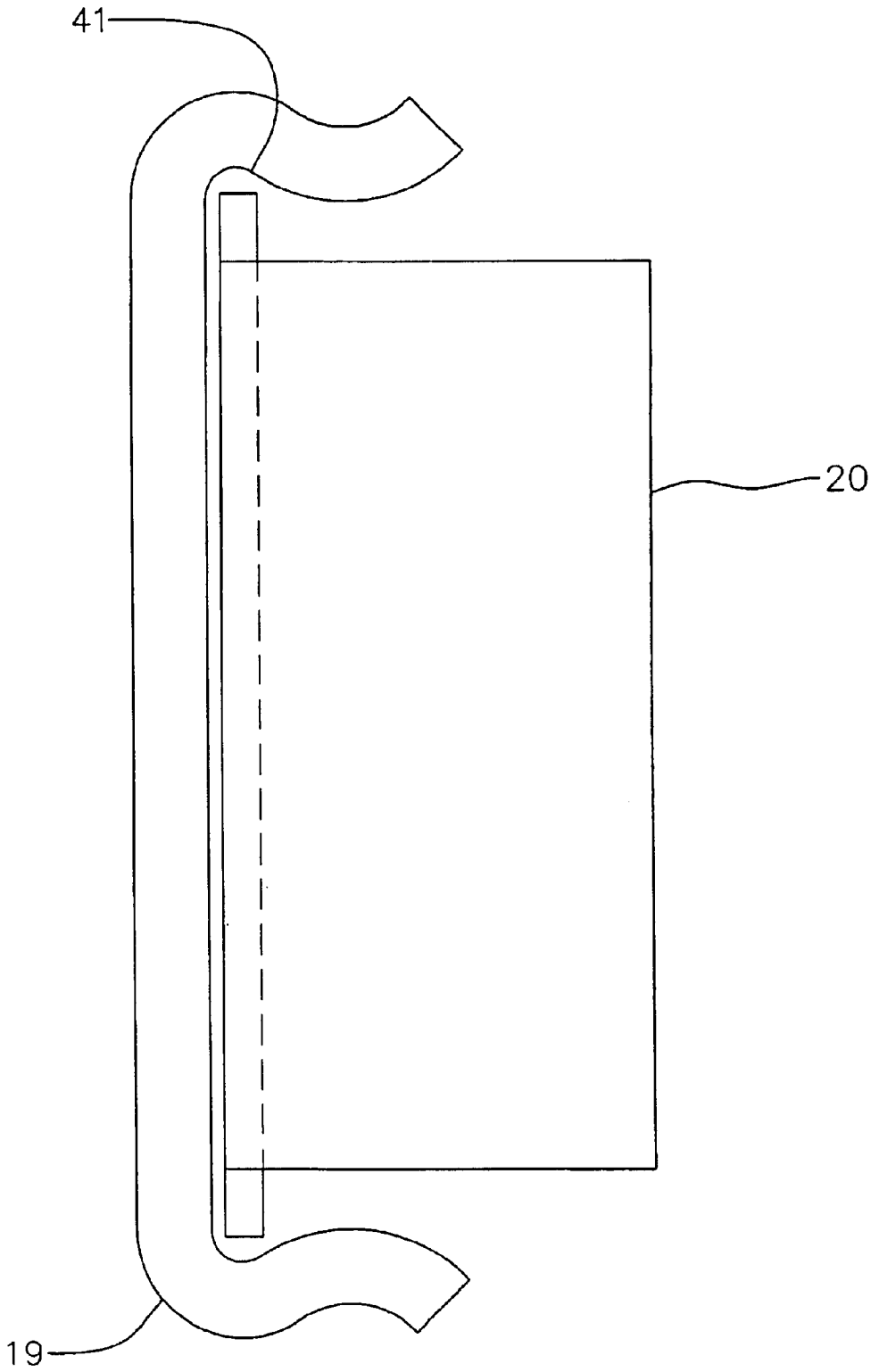
FIG. 4 is an end view of a slide member with a mechanism of the present invention installed thereon.

The mechanism in various embodiments is thin. Typical construction can be from 16 gauge steel. If the member size permits, the mechanism can be designed to fit inside the shape of the member allowing elimination of rivets. In an exemplary embodiment, the mechanism 20 fits slidably inside the radius 41 of the drawer member 19 as shown in FIG. 4. As indicated, the mechanism is held in place against a web of the slide member through contact with the interior of a bend in the drawer slide forming a bearing raceway. Thus, in one aspect the mechanism is placed in position, with the bearing raceways thereafter formed as part of a bending operation. Although illustrated in FIG. 4 as not impinging on the bearing raceway, in other embodiments the mechanism does so, but outside of the travel path of the bearings. Moreover, the mechanism is not itself bound by interaction between slide members, as is the latch, thereby increasing ease of operation.

Those skilled in the art will recognize that changes in the shape of the release mechanism and latch can result in different actions. One shape may create release action by pushing, while another cause release by pulling. More refined shapes could allow a release action for closing, but prevent disconnecting of the slide.

Furthermore, although illustrated in a ball bearing slide, the release device will work equally well in slides with roller bearings or of the friction type, with no bearings at all. Construction of the slides and release can be from metal, plastic, or other similar materials suitable to the function.

Accordingly, the present invention provides a mechanism for use with drawer slide latches. Although this invention has been described in certain specific embodiment, many additional modifications and variations would be apparent to those skilled in the art. It is therefore to be understood that this invention maybe practiced otherwise than as specifically described. Thus, the present embodiments of the invention should be considered as illustrative and not restrictive, the scope of the invention to be indicated by the claims and their equivalents supported by this application rather than the foregoing description.

What is claimed is:

1. A release mechanism for a slide comprising:

a telescopic drawer slide having a first member slidably coupled to a second member;

a latch member affixed to the first member, the latch member engaging a tab on the second member;

a mechanism translatably coupled to the first member, the mechanism translatable along the length of the first member to press against the latch member;

wherein the latch member is pivotally coupled to the first member, and the mechanism causes the latch member to pivot when translated to press against the latch member;

wherein the latch member includes a stop surface adapted to engage the tab and wherein the stop surface is part of a cutout of the latch member.

2. The release mechanism for a slide of claim 1, wherein the cutout forms a forward stop surface and a rearward stop surface, the forward stop surface engaging the tab to restrict rearward movement of the second slide member with respect to the first slide member and the rearward stop surface engaging the tab to restrict forward movement of the second slide member with respect to the first slide member.

3. A release mechanism for a slide comprising:

a telescopic drawer slide having a first member slidably coupled to a second member;

a latch member affixed to the first member, the latch member engaging a tab on the second member; and a mechanism translatably coupled to the first member, the mechanism translatable to press against the latch member, wherein the latch member is pivotally coupled to the first member, and the mechanism causes the latch member to pivot when translated to press against the latch, wherein the latch member includes a stop surface adapted to engage the tab, wherein the stop surface is part of a cutout of the latch member, wherein the cutout forms a forward stop surface and a rearward stop surface, the forward stop surface engaging the tab to restrict rearward movement of the second slide member with respect to the first slide member and the rearward stop surface engaging the tab to restrict forward movement of the second slide member with respect to the first slide member and wherein the translation of the mechanism results in pivot of the latch member sufficient to disengage the forward stop surface from the tab but insufficient to disengage the rearward stop surface from the tab.

4. In a drawer slide with a locking disconnect latch, the drawer slide being of the telescopic type with at least two elongate slides slidably coupled, with a first slide nested within a second slide, the first slide extendable from a retracted position substantially nested within the second slide to an extended position extending from the second slide, the locking disconnect latch comprising:

a lever pivotally mounted to the first slide, the lever including a cutout portion forming a stop surface, wherein the stop surface engages a tab on the second slide to simultaneously restrict a movement of the first slide with respect to the second slide in both a forward and a rearward direction with respect to the second slide member;

means for biasing the lever, the means for biasing the lever being coupled to the first slide; and wherein the means for biasing the lever biases the lever by linearly translating in a direction along the length of the first slide.

5. In a drawer slide with a locking disconnect latch, the drawer slide being of the telescopic type with at least two elongate slides slidably coupled, with a first slide nested within a second slide, the first slide extendable from a retracted position substantially nested within the second slide to an extended position extending from the second slide, the locking disconnect latch comprising:

a lever pivotally mounted to the first slide, the lever including a cutout portion forming a stop surface; and means for biasing the lever, the means for biasing the lever being coupled to the first slide, wherein the means for biasing the lever biases the lever by linearly translating in a direction along the length of the first slide, wherein the stop surface is adapted to abut a tab extending from the second slide when the first slide is in the extended position.

6. A release mechanism for a slide comprising:

a telescopic drawer slide having a first member slidably coupled to a second member;

a latch member affixed to the first member, the latch member engaging a tab on the second member;

a mechanism translatably coupled to the first member, the mechanism translatable along the length of the first member to press against the latch member;

wherein the latch member is pivotally coupled to the first member, and the mechanism causes the latch member to pivot when translated to press against the latch member; and wherein the latch member includes a forward stop surface and rearward stop surface, the forward stop surface restricting rearward movement of the second slide member with respect to the first slide member and the rearward stop surface restricting forward movement of the second slide member with respect to the first slide member.

7. A release mechanism for a slide comprising:

a telescopic drawer slide having a first member slidably coupled to a second member;

a latch member affixed to the first member, the latch member engaging a tab on the second member; and a mechanism translatably coupled to the first member, the mechanism translatable to press against the latch member, wherein the latch member includes a stop surface adapted to engage the tab and wherein the stop surface is part of a cutout of the latch member; and wherein the latch member is pivotally coupled to the first member, and the mechanism causes the latch member to pivot when translated to press against the latch.

* * * * *